US007104717B2

(12) United States Patent
Arheart

(10) Patent No.: US 7,104,717 B2
(45) Date of Patent: Sep. 12, 2006

(54) ROOF JOINT COVER

(75) Inventor: Thane Aaron Arheart, Andover, KS (US)

(73) Assignee: Balco, Inc., Wichita, KS (US)

( * ) Notice: Subject to any disclaimer, the term of this patent is extended or adjusted under 35 U.S.C. 154(b) by 64 days.

(21) Appl. No.: 10/798,461

(22) Filed: Mar. 11, 2004

(65) Prior Publication Data

US 2005/0201823 A1 Sep. 15, 2005

(51) Int. Cl.
*F16B 5/00* (2006.01)

(52) U.S. Cl. ..... 403/53

(58) Field of Classification Search ..... 403/124, 403/125, 126, 53, 56, 3, 121, 122, 143, 331; 53/393, 169.14, 97, 58, 60, 409, 411; 384/9, 384/29, 42

See application file for complete search history.

(56) References Cited

U.S. PATENT DOCUMENTS

| | | | | |
|---|---|---|---|---|
| 3,957,241 | A * | 5/1976 | Morris et al. | 248/288.31 |
| 4,063,839 | A | 12/1977 | Brown | |
| 4,537,003 | A * | 8/1985 | Huber et al. | 52/396.05 |
| 4,566,242 | A * | 1/1986 | Dunsworth | 52/396.01 |
| 4,956,955 | A * | 9/1990 | Ohmatsu | 52/396.05 |
| 5,383,738 | A * | 1/1995 | Herbermann | 403/56 |
| 5,468,092 | A * | 11/1995 | Saunders | 403/385 |
| 5,584,511 | A | 12/1996 | Gonzalez et al. | |
| 5,657,598 | A * | 8/1997 | Wilbs et al. | 52/287.1 |
| 5,941,038 | A | 8/1999 | Bristow et al. | |
| 6,250,035 | B1 | 6/2001 | Bristow et al. | |
| 6,357,192 | B1 * | 3/2002 | Schluter | 52/459 |
| 6,499,265 | B1 | 12/2002 | Shreiner | |
| 6,527,467 | B1 | 3/2003 | Betts | |
| 2002/0059764 | A1 * | 5/2002 | Schluter | 52/396.04 |
| 2003/0077110 | A1 * | 4/2003 | Knowles | 403/56 |
| 2003/0156890 | A1 * | 8/2003 | Tucker | 403/53 |

* cited by examiner

*Primary Examiner*—Daniel P. Stodola
*Assistant Examiner*—Joshua T. Kennedy
(74) *Attorney, Agent, or Firm*—Hovey Williams LLP

(57) ABSTRACT

A roof joint cover (10) that accommodates expansion, contraction, shear, and rotational movement between the surfaces (12,14) broadly comprises a first bracket (16) to be attached to a first surface (12), a second bracket (18) to be attached to a second surface (14), and a central bracket (20) to be installed between the first and second brackets (16,18). The first bracket (16) presents a cylindrical socket (24). The second bracket (18) presents a cylindrical plug (30). The central bracket (20) preferably presents a cylindrical plug (34) operable to fit within the socket (24) of the first bracket (16) and a cylindrical socket (36) offset from the plug (34) and operable to wrap around the plug (30) of the second bracket (18). The plug (34) of the central bracket (20) is perpendicular to the socket (36) of the central bracket (20), thereby accommodating linear and rotational movement along two perpendicular axis.

22 Claims, 4 Drawing Sheets

ROOF JOINT COVER

BACKGROUND OF THE INVENTION

1. Field of the Invention

The present invention relates to expansion joint covers. More particularly, the present invention relates to a roof joint cover that accommodates expansion, contraction, shear, and rotational movement between two surfaces.

2. Description of Prior Art

Buildings are typically constructed of rigid materials such as concrete and steel which are chosen for their ability to support loads and resist movement under those loads. Unfortunately, such rigid materials sometimes experience failures when they expand or contract due to changing temperatures or when they move due to seismic events.

To prevent failures, it is common practice to build expansion joints into buildings. Expansion joints are essentially gaps between two rigid surfaces of a building which allow the two surfaces to move with respect to each other without the failures described above.

Typically, an expansion joint is either filled, covered, or both. An expansion joint can be filled with a flexible material with desired characteristics such that it is, for example, waterproof and/or fire resistant. While the flexible material may effectively seal the expansion joint, it is typically not aesthetically appealing and therefore is often covered.

Several prior art expansion joint cover designs are commonly used. Some cover designs incorporate a plate which is secured to one of two surfaces to span an expansion joint between the two surfaces. An end of the plate typically slides against the other surface in order to accommodate variations in expansion and contraction. Unfortunately, these designs cannot effectively accommodate variations in sheer and torsion between the two surfaces.

Another prior art design includes a plate that slides within at least one housing. The housing is secured to one of two surfaces of an expansion joint. The plate is secured to the other surface. The plate slides within the housing in order to accommodate variations in expansion and contraction. However, the internal dimensions of the housing limit the allowable shear and torsion between the two surfaces.

Another prior art design includes a plate with a first end connected to one of two surfaces of an expansion joint by a hinge. A second end of the plate slides within a housing, which is fixedly mounted to the other surface. The plate is thus able to accommodate variations in expansion and separation between the two surfaces. The hinge is able to accommodate variations in torsion between the two surfaces. However, the internal dimensions of the housing still limit allowable shear between the two surfaces.

Accordingly, there is a need for an improved expansion joint cover that overcomes the limitations of the prior art. Specifically, there is a need for an improved roof joint cover that can accommodate variations in expansion, contraction, shear, and torsion between two surfaces of an expansion joint.

SUMMARY OF THE INVENTION

The present invention overcomes the above-identified problems and provides a distinct advance in the art of expansion joint covers. More particularly, the present invention provides a roof joint cover that accommodates expansion, contraction, shear, and rotational movement between a first surface and a second surface. The cover broadly comprises a cover plate to substantially span a gap between the surfaces, a first bracket to be attached to the cover plate, a second bracket to be attached to one of the surfaces, and a central bracket to be installed between the first and second brackets.

The cover plate is preferably substantially flat and presents a top face and a bottom face. The top face may include a decorative finish and the first bracket preferably attaches to the bottom face. The cover plate may also include a front flange to protect, hide or otherwise obscure the brackets or portions thereof. The cover plate is preferably attached to the first surface, and may therefore include a rear flange to be attached to the first surface.

The first bracket presents a rectangular attachment plate for attachment to the cover plate and a cylindrical socket longitudinally aligned with the attachment plate. The socket preferably includes two arcuate sidewalls that define a longitudinal slit substantially along the first bracket's entire length and preferably positioned opposite to the attachment plate.

The second bracket presents a rectangular attachment plate for attachment to the second surface, a cylindrical plug longitudinally aligned with the attachment plate, and a longitudinal neck offsetting the plug from the attachment plate substantially along the second bracket's entire length. The plug is preferably sized to fit snugly within the socket of the first bracket. In this regard, the first and second brackets may be used independently of the central bracket, but such a configuration would limit the functionality of the cover.

The central bracket presents a cylindrical plug operable to fit within the socket of the first bracket and a cylindrical socket offset from the plug and operable to wrap around the plug of the second bracket. The socket preferably includes two arcuate sidewalls that define a longitudinal slit substantially along the central bracket's entire length. It should be noted that the socket of the first bracket is preferably substantially identical to the socket of the central bracket. Similarly, the plug of the second bracket is preferably substantially identical to the plug of the central bracket.

Each plug preferably snugly fits within at least one of the sockets, such that the plugs may slide within the sockets. Additionally, since the necks of the plugs are substantially narrower than the slits of the sockets, the plugs may rotate within the sockets. Thus, the first bracket may slide and rotate with respect to the second bracket and the central bracket. Likewise, the second bracket may slide and rotate with respect to the first bracket and the central bracket. As a result, the first surface may slide and rotate with respect to the second surface. In this manner, the cover may accommodate expansion, contraction, shear, and/or rotational movement between the surfaces.

The central bracket is preferably configured with one mating member aligned perpendicularly with respect to another mating member. For example, the plug of the central bracket is preferably aligned at approximately ninety degrees with respect to the socket of the central bracket. In this manner, the cover accommodates linear and rotational movement along two perpendicular axes.

In use, an installer attaches the second bracket to the second surface. Then, the installer mates the central bracket to the second bracket by sliding the socket of the central bracket onto the plug of the second bracket. Next, the installer mates the first bracket to the central bracket by sliding the socket of the first bracket onto the plug of the central bracket. Finally, the installer attaches the cover plate to the first surface and the first bracket. Installed in this manner, the cover accommodates expansion, contraction, shear, and rotational movement between the surfaces.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
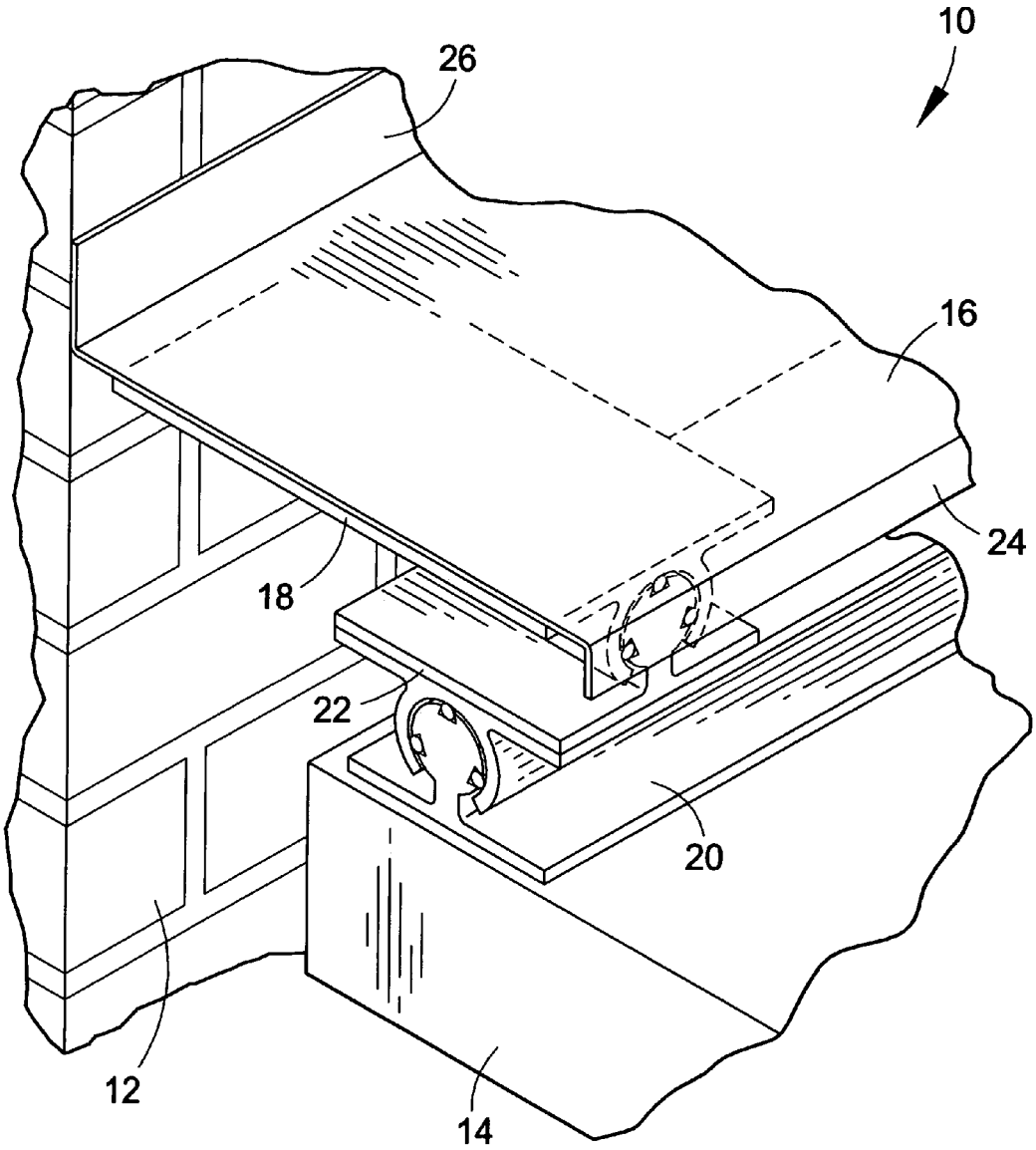
FIG. 1 is a perspective view of a roofjoint cover constructed in accordance with a preferred embodiment of the present invention and shown between two surfaces.

Referring to FIG. 1, a roof joint cover 10 constructed in accordance with a preferred embodiment of the present invention is illustrated between a first surface 12 and a second surface 14. The first surface 12 is preferably a wall of a building, while the second surface 14 is preferably a roof of the building or an adjacent building. However, the surfaces 12,14 may both be walls, roofs, other portions of the building, or portions of different but adjacent buildings. The cover 10 accommodates expansion, contraction, shear, and rotational movement between the surfaces 12,14. The cover 10 broadly comprises a cover plate 16 to substantially span a gap between the surfaces, a first bracket 18 to be attached to the cover plate 16, a second bracket 20 to be attached to the second surface 14, and a central bracket 22 to be installed between the first and second brackets 18,20.

The cover plate 16 is preferably constructed from a substantially flat sheet of metal, such as aluminum, steel, or copper, but may also be constructed from plastic, fiberglass, or another substantially rigid material. The cover plate 16 may also include a front flange 24 to protect, hide or otherwise obscure the brackets 18,20,22 or portions thereof. The front flange 24 preferably extends downwardly from a front edge of the cover plate 16 at an approximately ninety degree angle. The cover plate 16 is preferably attached to the first surface 12, and may therefore include a rear flange 26 to be attached to the first surface 16. The rear flange 26 preferably extends upwardly from a rear edge of the cover plate 16 at an approximately ninety degree angle. The cover plate 16 is sized to span the gap and presents a top face and a bottom face. The top face may include a decorative finish and the first bracket 18 preferably attaches to the bottom face.

Figure 2:
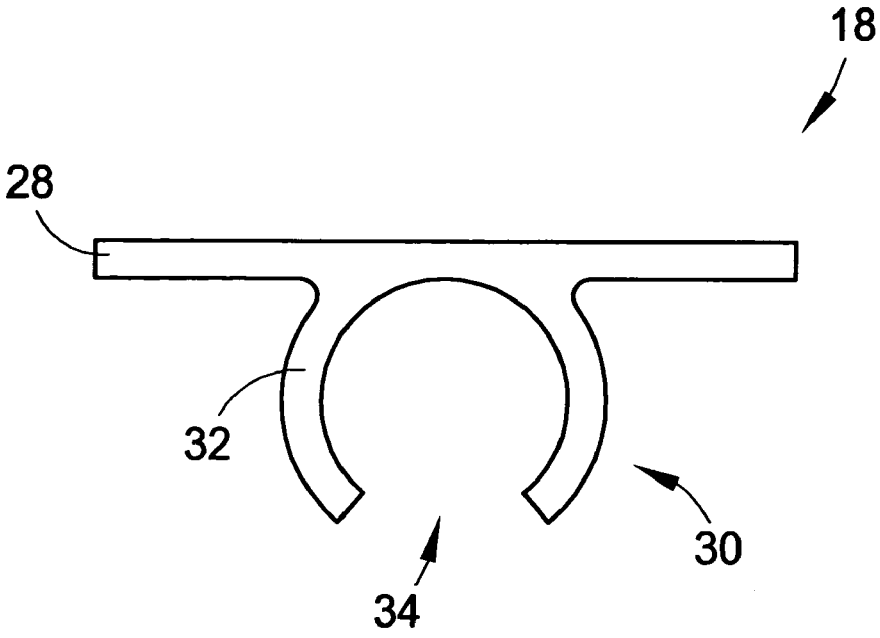
FIG. 2 is an elevation view of a first bracket of the cover.

Referring also to FIG. 2, the first bracket 18 preferably presents a rectangular attachment plate 28 for attachment to the cover plate 16 and a cylindrical socket 30 longitudinally aligned with the attachment plate 28. The socket 30 preferably includes two arcuate sidewalls 32 that define a longitudinal slit 34 along substantially the first bracket's 18 entire length and preferably positioned opposite to the attachment plate 28.

Figure 3:
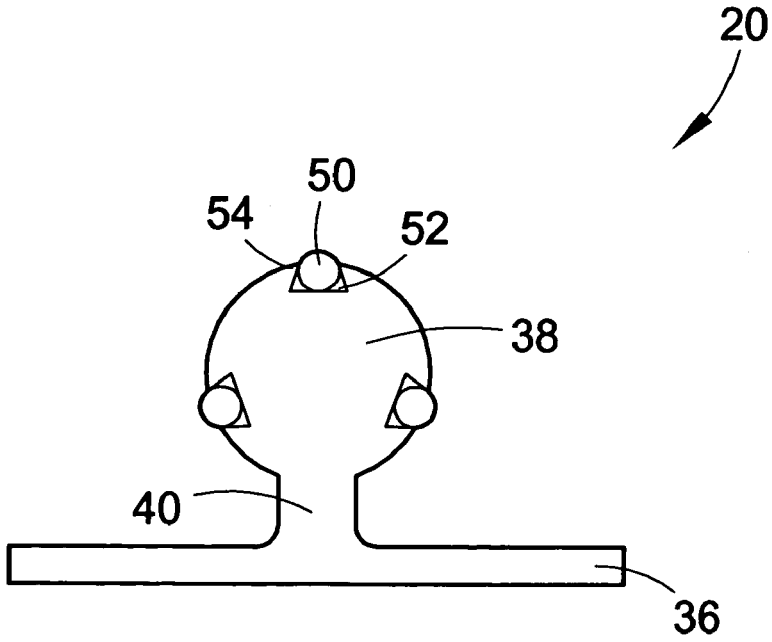
FIG. 3 is an elevation view of a second bracket of the cover.

Referring also to FIG. 3, the second bracket 20 preferably presents a rectangular attachment plate 36 for attachment to the second surface 14, a cylindrical plug 38 longitudinally aligned with the attachment plate 36, and a longitudinal neck 40 offsetting the plug 38 from the attachment plate 36 substantially along the second bracket's 20 entire length. The plug 38 is preferably sized to fit snugly within the socket 30 of the first bracket 18. In this regard, the first and second brackets 18,20 may be used independently of the central bracket 22, but such a configuration would limit the functionality of the cover 10.

Figure 4:
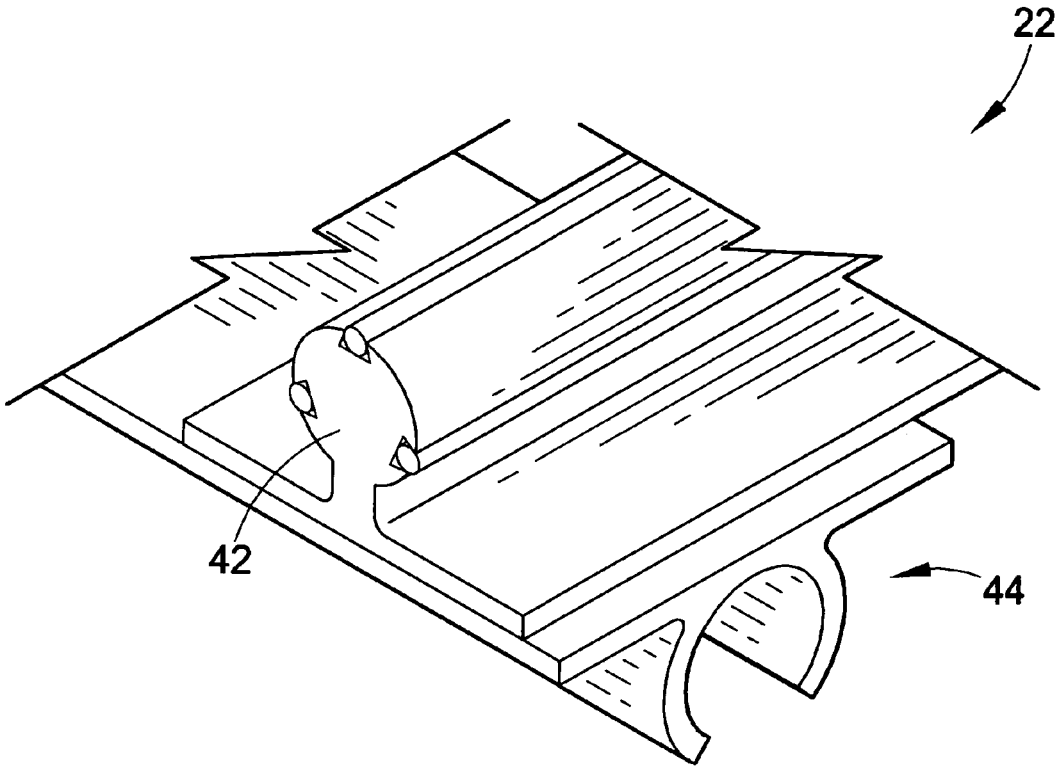
FIG. 4 is a perspective view of a central bracket of the cover.
Figure 5:
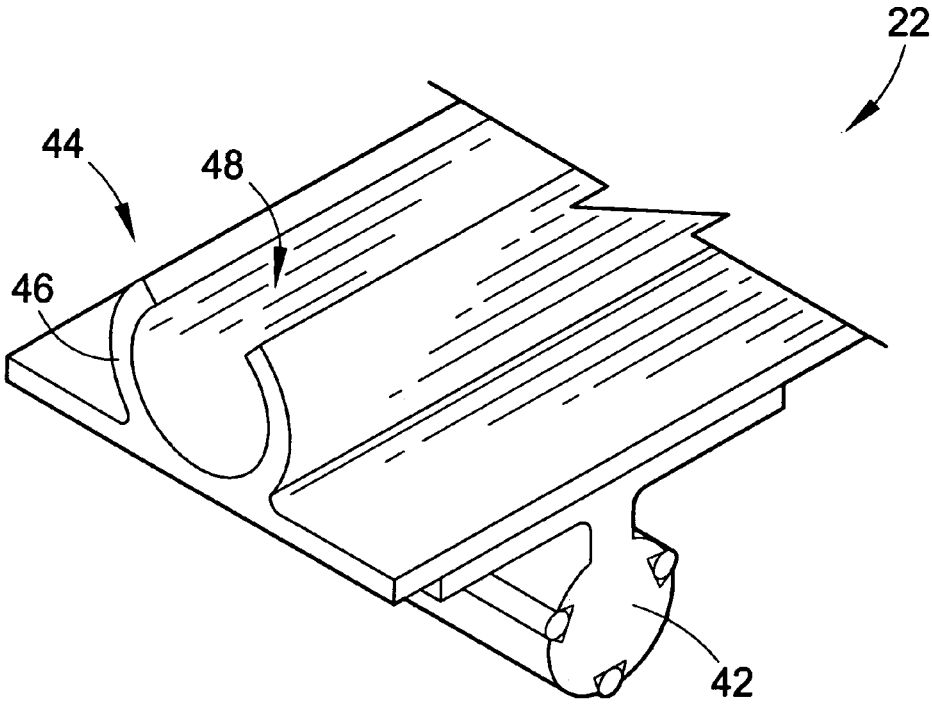
FIG. 5 is another perspective view of the central bracket of the cover.
Figure 6:
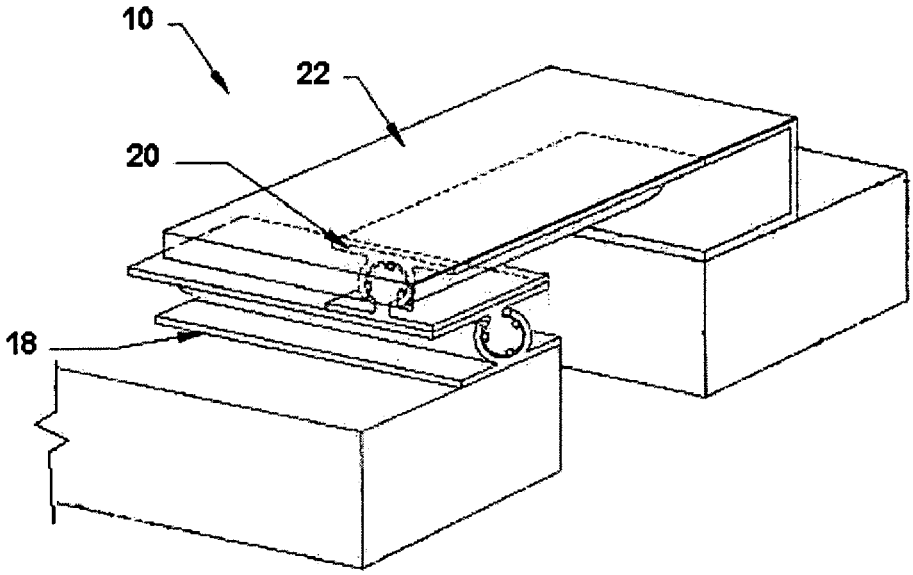
FIG. 6 is a perspective view of a roof joint cover constructed in accordance with various alternative preferred embodiments of the present invention, the cover shown including a first bracket presenting a first socket and a second bracket presenting a second socket.
Figure 7:
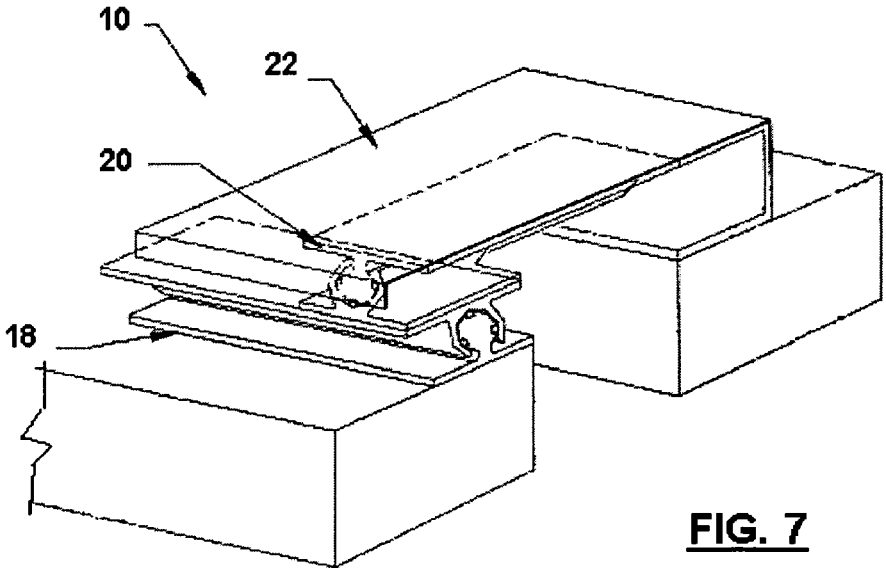
FIG. 7 is a perspective view of a roof joint cover constructed in accordance with various alternative preferred embodiments of the present invention, the cover shown including a first bracket presenting a first plug and a second bracket presenting a second plug.

Referring also to FIGS. 4 and 5, the central bracket 22 preferably presents a cylindrical plug 42 operable to fit within the socket 30 of the first bracket 18 and a cylindrical socket 44 offset from the plug 42 and operable to wrap around the plug 38 of the second bracket 20. The socket 44 preferably includes two arcuate sidewalls 46 that define a longitudinal slit 48 substantially along the central bracket's 22 entire length. It should be noted that the socket 30 of the first bracket 18 is preferably substantially identical to the socket 44 of the central bracket 22. Similarly, the plug 38 of the second bracket 20 is preferably substantially identical to the plug 42 of the central bracket 22.

Alternatively, the second bracket 20 may be substantially identical to the first bracket 18. In this case, the second bracket 20 would present a rectangular attachment plate for attachment to the second surface 14 and a cylindrical socket longitudinally aligned with the attachment plate and including a longitudinal slit along its entire length. Additionally, in this case, the central bracket would preferably present two plugs.

Alternatively, the first bracket 18 may be substantially identical to the second bracket 20. In this case, the first bracket 18 would present a rectangular attachment plate for attachment to the cover plate 16, a cylindrical plug longitudinally aligned with the attachment plate, and a longitudinal neck offsetting the plug from the attachment plate substantially along its entire length. Additionally, in this case, the central bracket would preferably present two sockets.

In any case, each plug 38,42 preferably snugly fits within at least one of the sockets 30,44, such that the plugs 38,42 may slide longitudinally within the sockets 30,44. Additionally, since the necks 40 of the plugs 38,42 are substantially narrower than the slits 34,48 of the sockets 30,44, the plugs 38,42 may rotate within the sockets 30,44. Thus, the first bracket 18 may slide and rotate with respect to the second bracket 20 and the central bracket 22. Likewise, the second bracket 20 may slide and rotate with respect to the first bracket 18 and the central bracket 22. As a result, the first surface 12 may slide and rotate with respect to the second surface 14. In this manner, the cover 10 may accommodate expansion, contraction, shear, and/or rotational movement between the surfaces 12,14.

The central bracket 22 is preferably configured with one mating member aligned perpendicularly, or at an approximately ninety degree angle, with respect to another mating member. For example, the plug 42 of the central bracket 22 is preferably aligned at approximately ninety degrees with respect to the socket 44 of the central bracket 22. Alternatively, where the central bracket 22 comprises two plugs, one of the plugs is preferably aligned at approximately ninety degrees with respect to the other plug. Alternatively, where the central bracket 22 comprises two sockets one of the sockets is preferably aligned at approximately ninety degrees with respect to the other socket. In this manner, the cover 10 accommodates linear and rotational movement along two perpendicular axis. Of course, should the angle between the mating members be another specific angle, other than ninety degrees, the cover 10 would then accommodate linear and rotational movement along two axes aligned at the specific angle.

The brackets 18,20,22 are preferably constructed of extruded aluminum, but may be constructed of other rigid and weather resistant material. For example, the brackets 18,20,22 may be constructed of plastic or stainless steel. Alternatively, under some circumstances, such as where the cover 10 is to be used in a controlled environment, the brackets 18,20,22 may not need to be weather resistant.

Each plug 38,42 may also include bearings 50 along its entire length. The bearings 50 eliminate or reduce noise, friction, and/or wear associated with the plugs 38,42 sliding and rotating within the sockets 30,44. The bearings 50 are preferably constructed of brass, plastic, or other material commonly used to make bearings. The bearings 50 are preferably seated in triangular cut-outs 52 along the plugs 38,42. The cut-outs 52 are preferably defined by inwardly sloping sidewalls 54 that retain the bearings 50. In the preferred embodiment, each plug 38,42 preferably includes three bearings 50. This configuration provides three lines of contact, thereby preventing the plugs 38,42 from directly contacting the sockets 30,44, while minimizing complexity. However, each plug 38,42 may contain more or fewer bearings 50 and cut-outs 52 than described in the preferred embodiment. For example, the plugs 38,42 may contain four bearings 50 and four cut-outs 52. Alternatively, the plugs 38,42 may contain only two bearings 50 and two cut-outs 52.

The attachment plates 28,36 are preferably approximately one quarter inch thick. Similarly, the sidewalls 32,46 of the sockets 30,44 are preferably approximately one quarter inch thick. The plugs 38,42 are preferably approximately one inch in diameter. Thus, the sockets 30,44 preferably include an approximately one inch internal diameter and an approximately one and one half inch external diameter. The necks 40 are preferably approximately one quarter inch in thickness and offset the plugs 38,42 approximately one half inch from the attachment plates 36. Therefore, in order to provide adequate rotation, the slits 34,48 are preferably approximately one half inch wide.

It should be noted that the lengths of the brackets 18,20,22 are dependant upon the dimensions of the surfaces 12,14 and the gap therebetween, as well as the expected movement therebetween. For example, a longer bracket is required where the surfaces 12,14 are expected to experience a greater degree of movement.

While the present invention has been described above, it is understood that other materials and/or dimensions can be substituted. These and other minor modifications are within the scope of the present invention. For example, the attachment plates 28,36 may include a plurality of holes, through which nails, threaded fasteners, or rivets may be used to attach the first and second brackets 18,20 to the surfaces 12,14 and/or the cover plate 16. Alternatively, the plates 28,36 may be attached to the surfaces 12,14 and/or the cover plate 16 using adhesives and/or welds. Additionally, both the first and second brackets 18,20 could present plugs, while the central bracket 22 presents two sockets. Furthermore, the sockets 30,44 and plugs 38,42 have been shown as being substantially centered along the attachment plates 28,36. However, any of the sockets 30,44 and/or plugs 38,42 may be positioned along a side of the attachment plates 28,36 or otherwise offset from each attachment plates' 28,36 center.

While the first bracket 18 has been described as being attached to the first surface 12 indirectly through the cover plate 16, the first bracket 18 may be directly attached to the first surface 12. In this case, the second bracket 20 may be attached to the second surface 14 indirectly through the cover plate 16. Alternatively, the cover 10 may include a substitute significantly different than the cover plate 16 described herein.

Finally, in order to simplify construction, the central bracket 22 may be constructed as a combination of the first and second brackets 18,20. For example, the first bracket 18 may be extruded longer than necessary and then cut down to a required size. Similarly, the second bracket 20 may be extruded longer than necessary and then cut down to a required size. Rather than discarding portions cut away from the first and second brackets 18,20, those portions can be secured to each other, attachment plate 28 to attachment plate 36, in order to construct the central bracket 22.

In use, an installer attaches the second bracket 20 to the second surface 14. Then, the installer mates the central bracket 22 to the second bracket 20 by sliding the socket 44 of the central bracket 22 onto the plug 38 of the second bracket 20. Next, the installer mates the first bracket 18 to the central bracket 22 by sliding the socket 30 of the first bracket 18 onto the plug of the central bracket 42. Finally, the installer attaches the cover plate 16 to the first surface 12 and the first bracket 18. Installed in this manner, the cover 10 accommodates expansion, contraction, shear, and rotational movement between the surfaces 12,14.

Having thus described a preferred embodiment of the invention, what is claimed as new and desired to be protected by Letters Patent includes the following:

The Invention claimed is:

1. An expansion joint cover operable to accommodate movement of a first surface with respect to a second surface, the cover comprising:

a cover plate operable to substantially span a gap between the first surface and the second surface;

a first bracket presenting a first mating member and operable to be rigidly attached to one of the first surface, the second surface, and the cover plate;

a second bracket presenting a second mating member and operable to be rigidly attached to another one of the first surface, the second surface, and the cover plate; and a central bracket operable to be installed between the first and second brackets, the central bracket including a third mating member operable to mate with the first member, slide with respect to the first member, and rotate with respect to the first member, and a fourth mating member operable to mate with the second member, slide with respect to the second member, and rotate with respect to the second member, the fourth member being rigidly attached to the third member and the longitudinal axis of an elongated portion of the fourth member being generally perpendicular to the longitudinal axis of an elongated portion of the third member.

2. The cover as set forth in claim 1, wherein the first member presents a cylindrical socket with a longitudinal slit.

3. The cover as set forth in claim 2, wherein the third member presents a cylindrical plug operable to fit within the socket.

4. The cover as set forth in claim 1, wherein the fourth member presents a cylindrical socket with a longitudinal slit.

5. The cover as set forth in claim 4, wherein the second member presents a cylindrical plug operable to fit within the socket.

6. The cover as set forth in claim 1, wherein the second member presents a cylindrical socket with a longitudinal slit.

7. The cover as set forth in claim 6, wherein the fourth member presents a cylindrical plug operable to fit within the socket.

8. The cover as set forth in claim 1, wherein the first member presents a first cylindrical socket, the third member presents a first cylindrical plug operable to fit within the first socket, the fourth member presents a second cylindrical socket, and the second member presents a second cylindrical plug operable to fit within the second socket.

9. The cover as set forth in claim 8, wherein each plug includes at least one bearing to reduce friction between the plugs and the sockets.

10. The cover as set forth in claim 1, wherein the first member presents a first cylindrical socket, the third member presents a first cylindrical plug operable to fit within the first socket, the second member presents a second cylindrical socket, and the fourth member presents a second cylindrical plug operable to fit within the second socket.

11. The cover as set forth in claim 10, wherein each plug includes at least one bearing to reduce friction between the plugs and the sockets.

12. A roof joint cover operable to accommodate expansion, contraction, shear, and rotational movement of a first surface with respect to a second surface, the cover comprising:

a first bracket operable to be rigidly attached to a cover plate which is to be attached to the first surface, the first bracket presenting a first cylindrical socket with a longitudinal slit substantially along its entire length;

a second bracket operable to be rigidly attached to the second surface and presenting a first cylindrical plug generally perpendicular to the first cylindrical socket; and a central bracket operable to be installed between the first and second brackets, the central bracket including a second cylindrical plug operable to fit within the first socket, slide with respect to the first bracket, and rotate with respect to the first bracket, and a second cylindrical socket with a longitudinal slit substantially along its entire length, secured at an approximately ninety degree angle to the second plug, operable to fit around the first plug, operable to slide with respect to the second bracket, and operable to rotate with respect to the second bracket.

13. The cover as set forth in claim 12, wherein each plug includes at least one bearing along its entire length to reduce friction between the plugs and the sockets.

14. The cover as set forth in claim 12, wherein each plug is approximately one inch in diameter and each socket includes arcuate sidewalls approximately one quarter inch in thickness.

15. A roof joint cover operable to accommodate expansion, contraction, shear, and rotational movement of a first surface with respect to a second surface, the cover comprising:

a first bracket operable to be rigidly attached to a cover plate which is to be attached to the first surface, the first bracket presenting a first cylindrical socket with a longitudinal slit substantially along its entire length;

a second bracket operable to be rigidly attached to the second surface and presenting a second cylindrical socket, generally perpendicular to the first cylindrical socket, with a longitudinal slit substantially along its entire length, a central bracket operable to be installed between the first and second brackets, the central bracket including a first cylindrical plug operable to fit within the first socket, slide with respect to the first bracket, and rotate with respect to the first bracket, and a second cylindrical plug secured at an approximately ninety degree angle to the first plug and operable to fit within the second socket, slide with respect to the second bracket, and rotate with respect to the second bracket.

16. The cover as set forth in claim 15, wherein each plug includes at least one bearing along its entire length to reduce friction between the plugs and the sockets.

17. The cover as set forth in claim 15, wherein each plug is approximately one inch in diameter and each socket includes arcuate sidewalls approximately one quarter inch in thickness.

18. A roof joint cover operable to accommodate expansion, contraction, shear, and rotational movement of a first surface with respect to a second surface, the cover comprising:

a first bracket operable to be rigidly attached to a cover plate which is to be attached to the first surface, the first bracket presenting a first cylindrical plug;

a second bracket operable to be rigidly attached to the second surface and presenting a second cylindrical plug generally perpendicular to the first cylindrical plug; and a central bracket operable to be installed between the first and second brackets, the central bracket including a first cylindrical socket with a longitudinal slit substantially along its entire length and operable to fit around the first plug, slide with respect to the first bracket, and rotate with respect to the first bracket, and a second cylindrical socket with a longitudinal slit substantially along its entire length, the second socket being secured at an approximately ninety degree angle to the first socket and operable to fit around the second plug, slide with respect to the second bracket, and rotate with respect to the second bracket.

19. The cover as set forth in claim 18, wherein each plug includes at least one bearing along its entire length to reduce friction between the plugs and the sockets.

20. The cover as set forth in claim 18, wherein each plug is approximately one inch in diameter and each socket includes arcuate sidewalls approximately one quarter inch in thickness.

21. The cover as set forth in claim 18, wherein the central bracket does not bridge a joint formed between the first surface and the second surface.

22. The cover as set forth in claim 18, wherein the length of the first socket is less than the length of the first plug and the length of the second socket is less than the length of the second plug.

* * * * *